US007510168B1

(12) United States Patent
Lin

(10) Patent No.: US 7,510,168 B1
(45) Date of Patent: Mar. 31, 2009

(54) CABLE TENSION DEVICE HAVING A TENSION ADJUSTABLE FUNCTION

(75) Inventor: Chia-Sheng Lin, Changhua Hsien (TW)

(73) Assignee: Jia Hsin Press Cast Industry Co., Ltd., Changhua Hsien (TW)

( * ) Notice: Subject to any disclaimer, the term of this patent is extended or adjusted under 35 U.S.C. 154(b) by 353 days.

(21) Appl. No.: 11/541,864

(22) Filed: Oct. 2, 2006

(51) Int. Cl.
*B21F 9/00* (2006.01)

(52) U.S. Cl. ..... 254/218; 254/223; 24/70 ST; 24/69 ST; 24/68 CD; 24/69 CT; 410/103

(58) Field of Classification Search ..... 254/218, 254/223, 238, 239; 24/70 ST, 69 ST, 69 CT, 24/68 CD; 410/103
See application file for complete search history.

(56) References Cited

U.S. PATENT DOCUMENTS 2,969,221 A * 1/1961 Harmes ..... 254/218
3,998,429 A * 12/1976 Cheung ..... 254/218
4,542,883 A * 9/1985 Rutzki ..... 254/217
5,103,536 A * 4/1992 Kamper ..... 24/68 CD
5,271,606 A * 12/1993 Kamper ..... 254/217
5,943,742 A * 8/1999 Huang ..... 24/68 CD
7,374,152 B2 * 5/2008 Ruan ..... 254/217
2008/0104811 A1 * 5/2008 Burrows et al. ..... 24/68 CD
2008/0201922 A1 * 8/2008 Ruan ..... 24/68 CD

* cited by examiner

*Primary Examiner*—Emmanuel M Marcelo
(74) *Attorney, Agent, or Firm*—Alan Kamrath; Kamrath & Associates PA

(57) ABSTRACT

A cable tension device includes a fixing seat, a rotation shaft, a ratchet unit, a movable seat, a safety locking plate, a control member, an engaging board, a push board, a compression spring, and a tension adjustment knob. Thus, when the cable is tightened to a determined extent by rotation of the movable seat, the force applied by the cable on the ratchet unit is greater than that applied by the engaging board and the push board on the ratchet unit, so that the engaging board is pushed and deflected by the ratchet unit to pass by the ratchet unit, and the movable seat performs an idle rotation, thereby preventing the cable from being tightened too excessively.

20 Claims, 10 Drawing Sheets

CABLE TENSION DEVICE HAVING A TENSION ADJUSTABLE FUNCTION

BACKGROUND OF THE INVENTION

1. Field of the Invention

The present invention relates to a cable tension device and, more particularly, to a cable tension device for tightening a cable to bind a cargo.

2. Description of the Related Art

A conventional cable tension device comprises a fixing seat, a rotation shaft rotatably mounted on the fixing seat to wind and unwind a cable, a ratchet unit secured on the rotation shaft to rotate the rotation shaft, a movable seat rotatably mounted on the rotation shaft, an locking plate mounted on the fixing seat and detachably engaged with the ratchet unit to allow the ratchet unit to rotate forward in one direction only, an elastic engaging board mounted on the movable seat and detachably engaged with the ratchet unit to drive the ratchet unit to rotate forward in the one direction only.

In operation, when the movable seat is rotatable relative to the fixing seat forward, the engaging board is rotatable with the movable seat to drive the ratchet unit to rotate forward to rotate the rotation shaft forward so as to wind the cable. At this time, the locking plate is engaged with the ratchet unit to prevent the ratchet unit from being rotated backward. On the contrary, when the movable seat is rotatable relative to the fixing seat backward, the engaging board is rotatable with the movable seat to pass through the ratchet unit without interfering with operation of the ratchet unit. Thus, the movable seat is rotatable relative to the fixing seat forward successively to rotate the rotation shaft forward to wind and tighten the cable successively so as to bind a cargo.

However, the user easily applies an excessive force on the movable seat to tighten the cable too excessively by successive rotation of the movable seat, so that the cargo is easily worn or broken due to the excessive force applied by the cable.

BRIEF SUMMARY OF THE INVENTION

The primary objective of the present invention is to provide a cable tension device having a tension adjustable function.

Another objective of the present invention is to provide a cable tension device, wherein when the cable is tightened to a determined extent by rotation of the movable seat, the force applied by the cable on the ratchet unit is greater than that applied by the engaging board and the push board on the ratchet unit, so that the engaging board is pushed and deflected by the ratchet unit to pass by the ratchet unit, and the movable seat performs an idle rotation, thereby preventing the cable from being tightened too excessively.

A further objective of the present invention is to provide a cable tension device, wherein the tension adjustment knob is rotatable relative to the movable seat to adjust the tension applied by the compression spring on the push board to adjust the force applied by the engaging board and the push board on the ratchet unit so as to adjust the force for tightening the cable, thereby preventing the cargo from being broken by the cable due to an excessive force.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
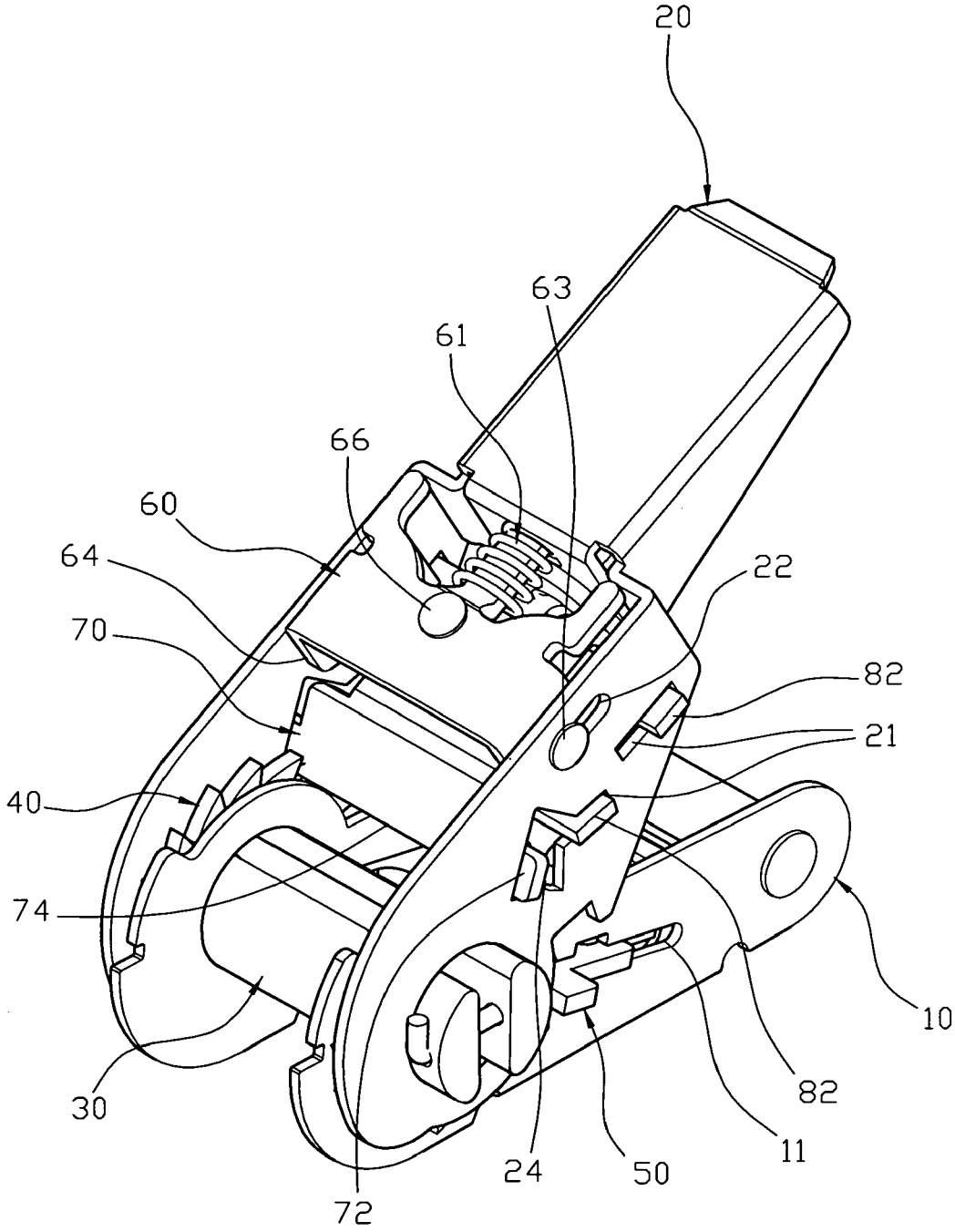
FIG. 1 is a perspective view of a cable tension device in accordance with the preferred embodiment of the present invention.
Figure 2:
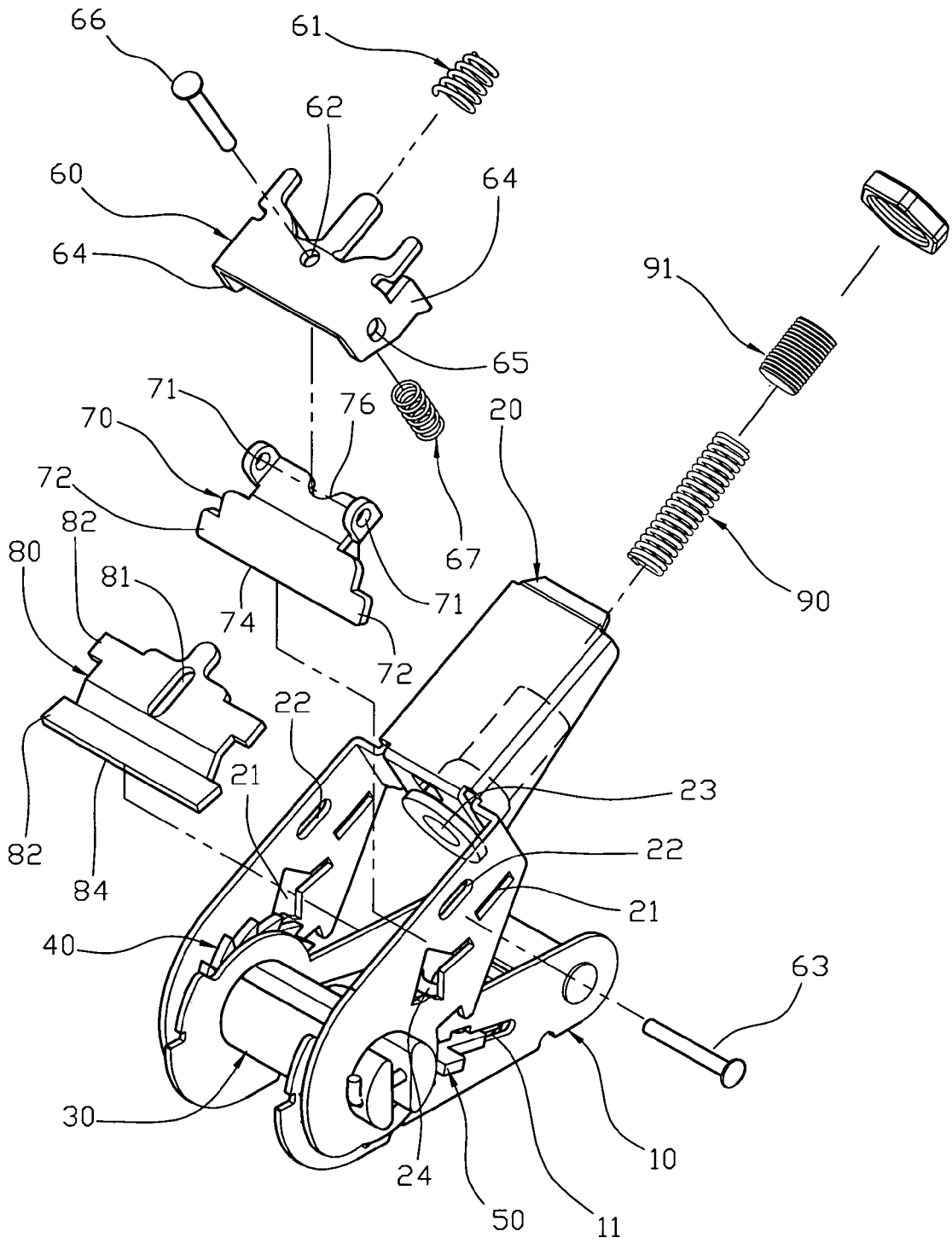
FIG. 2 is an exploded perspective view of the cable tension device as shown in FIG. 1.
Figure 3:
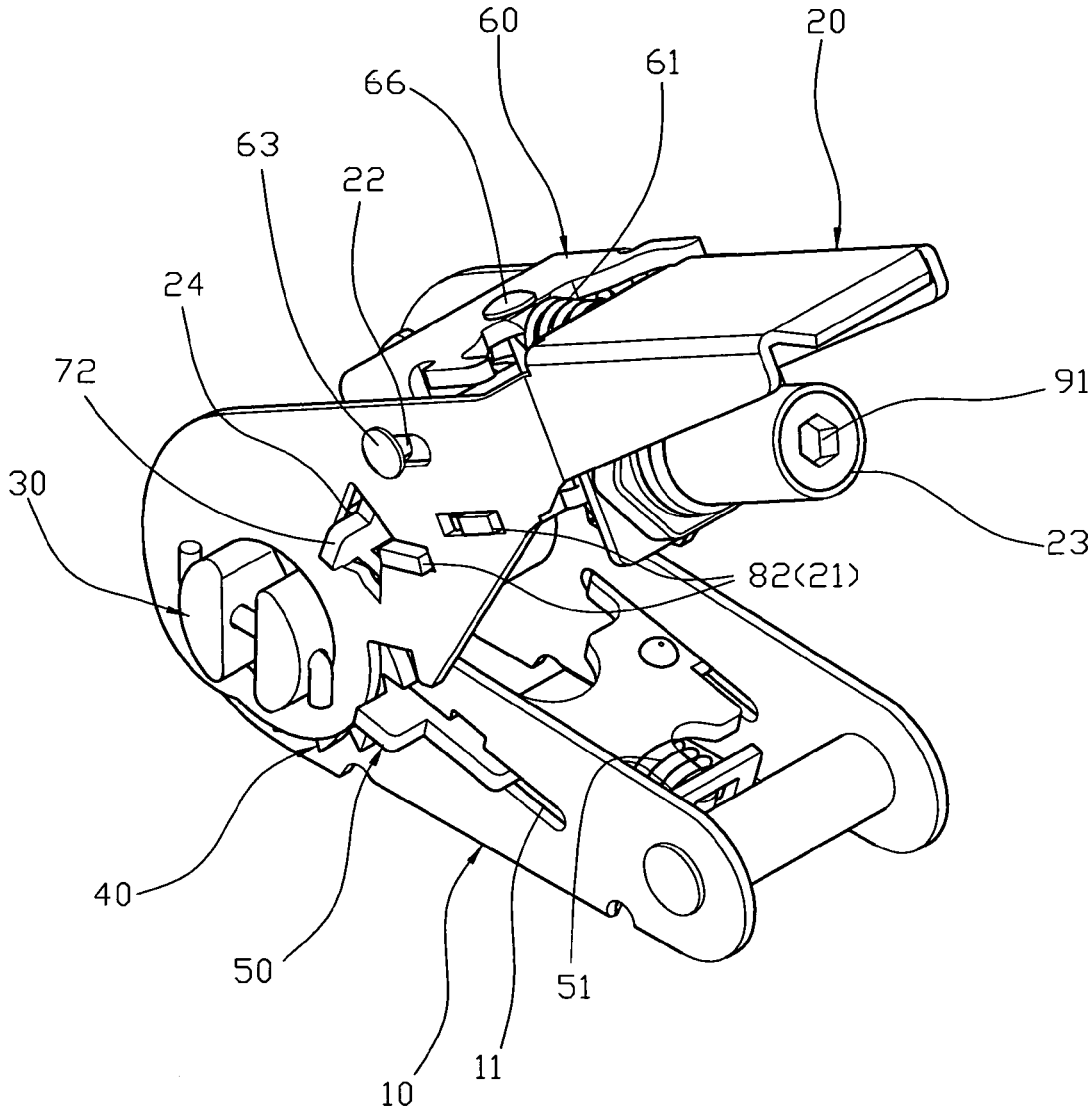
FIG. 3 is a rear perspective view of the cable tension device as shown in FIG. 1.

Referring to the drawings and initially to FIGS. 1-4, a cable tension device in accordance with the preferred embodiment of the present invention comprises a fixing seat 10, a rotation shaft 30 rotatably mounted on the fixing seat 10, a ratchet unit 40 secured on the rotation shaft 30 to rotate the rotation shaft 30, a movable seat 20 rotatably mounted on the rotation shaft 30, a safety locking plate 50 movably mounted on the fixing seat 10 and detachably engaged with the ratchet unit 40 to allow the ratchet unit 40 to rotate forward in one direction only, a control member 60 movably mounted on the movable seat 20, an engaging board 70 pivotally connected with the control member 60 and detachably engaged with the ratchet unit 40 to drive the ratchet unit 40 to rotate forward in the one direction only, a push board 80 movably mounted on the movable seat 20 and rested on the engaging board 70 to push the engaging board 70 to deflect forward in an inclined angle, a compression spring 90 biased between the movable seat 20 and the push board 80 to push the push board 80 toward the engaging board 70, and a tension adjustment knob 91 adjustably mounted on the movable seat 20 and rested on the compression spring 90 to adjust a tension applied by the compression spring 90 on the push board 80.

The fixing seat 10 has a mediate portion formed with an elongated slideway 50 in which the safety locking plate 50 movable.

The rotation shaft 30 is rotatably mounted on a first end of the fixing seat 10 to wind and unwind a cable (not shown), and a push spring 51 is biased between a second end of the fixing seat 10 and the safety locking plate 50 to push the safety locking plate 50 toward the ratchet unit 40.

The ratchet unit 40 is located on two ends of the rotation shaft 30.

The movable seat 20 has a first end rotatably mounted on the rotation shaft 30 and a second end formed with a threaded adjusting hole 23. The movable seat 20 has a mediate portion having two opposite sides each formed with a guide slot 22, two guide channels 21 and a guide groove 24. The guide groove 24 of the movable seat 20 is connected to one of the guide channels 21.

The control member 60 has a face formed with a through hole 62. The control member 60 has a substantially inverted U-shaped cross-sectional profile and has two downward extending slides 64 each movably mounted in the movable seat 20 and each formed with an oblong guide hole 65.

An elastic member 61 is mounted on the control member 60 and biased between the movable seat 20 and the control member 60 to push the control member 60 toward the engaging board 70 and to push the engaging board 70 toward the ratchet unit 40.

The engaging board 70 has a first end formed with an engaging end 74 detachably engaged with the ratchet unit 40 and a second end formed with two upward extending pivot ears 71 pivotally mounted in the control member 60. The engaging board 70 has two opposite sides each formed with a protruding slide edge 72 slidable in the respective guide groove 24 of the movable seat 20.

A pivot pin 63 is extended through the guide slots 22 of the movable seat 20, the guide holes 65 of the control member 60 and the pivot ears 71 of the engaging board 70, so that the control member 60 is movable forward and backward on the movable seat 20 by guidance of the guide slots 22 of the movable seat 20, and is movable upward and downward on the movable seat 20 by guidance of the guide holes 65 of the control member 60. In addition, the engaging board 70 is movable with the control member 60 and is pivotable relative to the control member 60 by pivot of the pivot pin 63.

The push board 80 has a first end formed with a push end 84 rested on the first end of the engaging board 70 and a second end formed with an elongated limit slot 81. The push board 80 has two opposite sides each formed with two protruding slide portions 82 each slidable in the respective guide channel 21 of the movable seat 20.

The cable tension device further comprises a limit pin 66 extended through the through hole 62 of the control member 60 and the limit slot 81 of the push board 80, so that the push board 80 is movable forward and backward relative to the control member 60 by guidance of the limit pin 66, and a restoring spring 67 mounted on the limit pin 66 and biased between the control member 60 and the push board 80 to push the control member 60 upward and downward. The second end of the engaging board 70 is formed with an arcuate recess 76 to receive the limit pin 66.

The compression spring 90 is mounted in the adjusting hole 23 of the movable seat 20 and biased between the tension adjustment knob 91 and the second end of the push board 80.

The tension adjustment knob 91 is a threaded rod screwed into the adjusting hole 23 of the movable seat 20, so that the tension adjustment knob 91 is rotatable relative to the movable seat 20.

Figure 4:
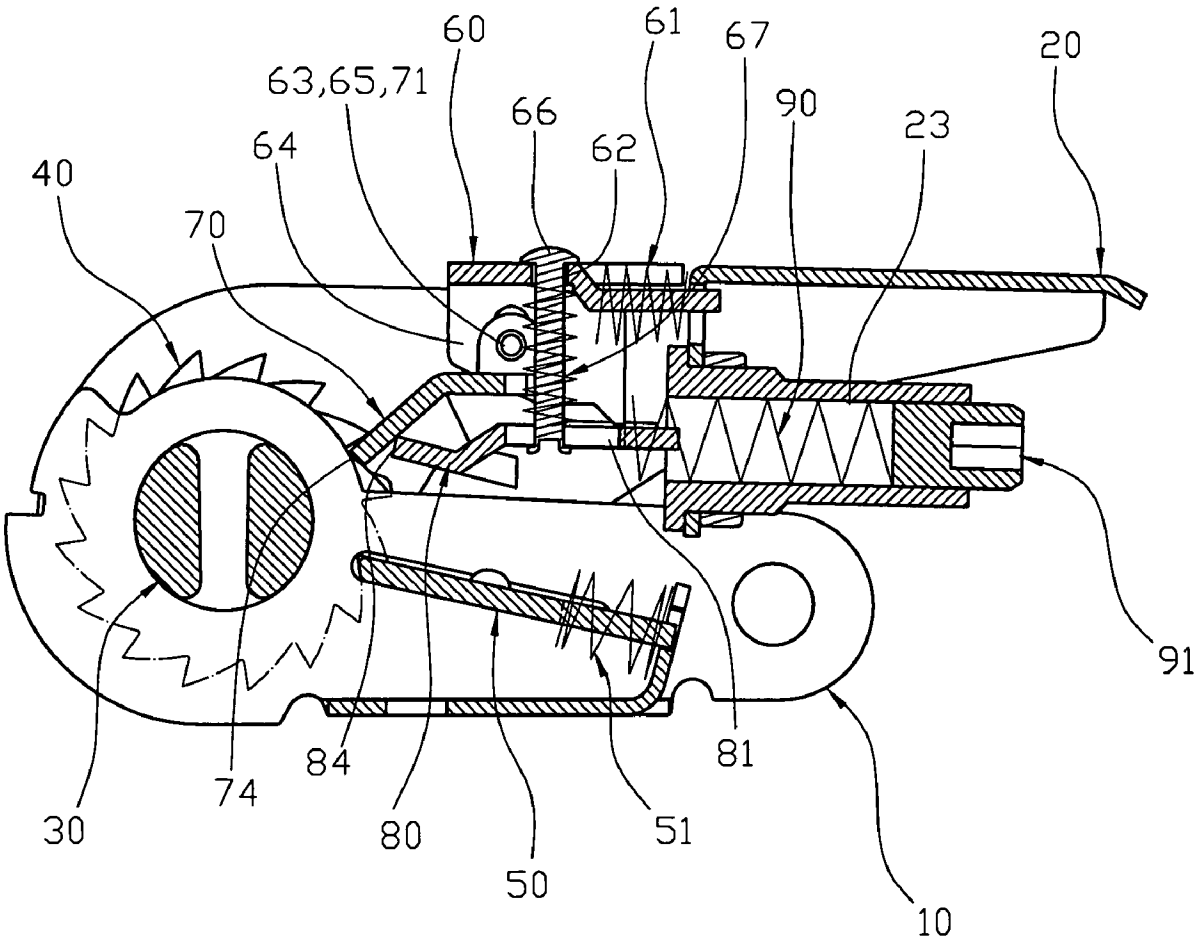
FIG. 4 is a plan cross-sectional view of the cable tension device as shown in FIG. 1.

As shown in FIG. 4, the elastic member 61 pushes the control member 60 toward the engaging board 70 and pushes the engaging board 70 toward the ratchet unit 40, so that the engaging board 70 is engaged with the ratchet unit 40 at a normal state, while the compression spring 90 pushes the push board 80 toward the engaging board 70 to push the engaging board 70 to deflect forward in an inclined angle, so that the engaging board 70 is engaged with the ratchet unit 40 closely and exactly at the normal state.

Figure 5:
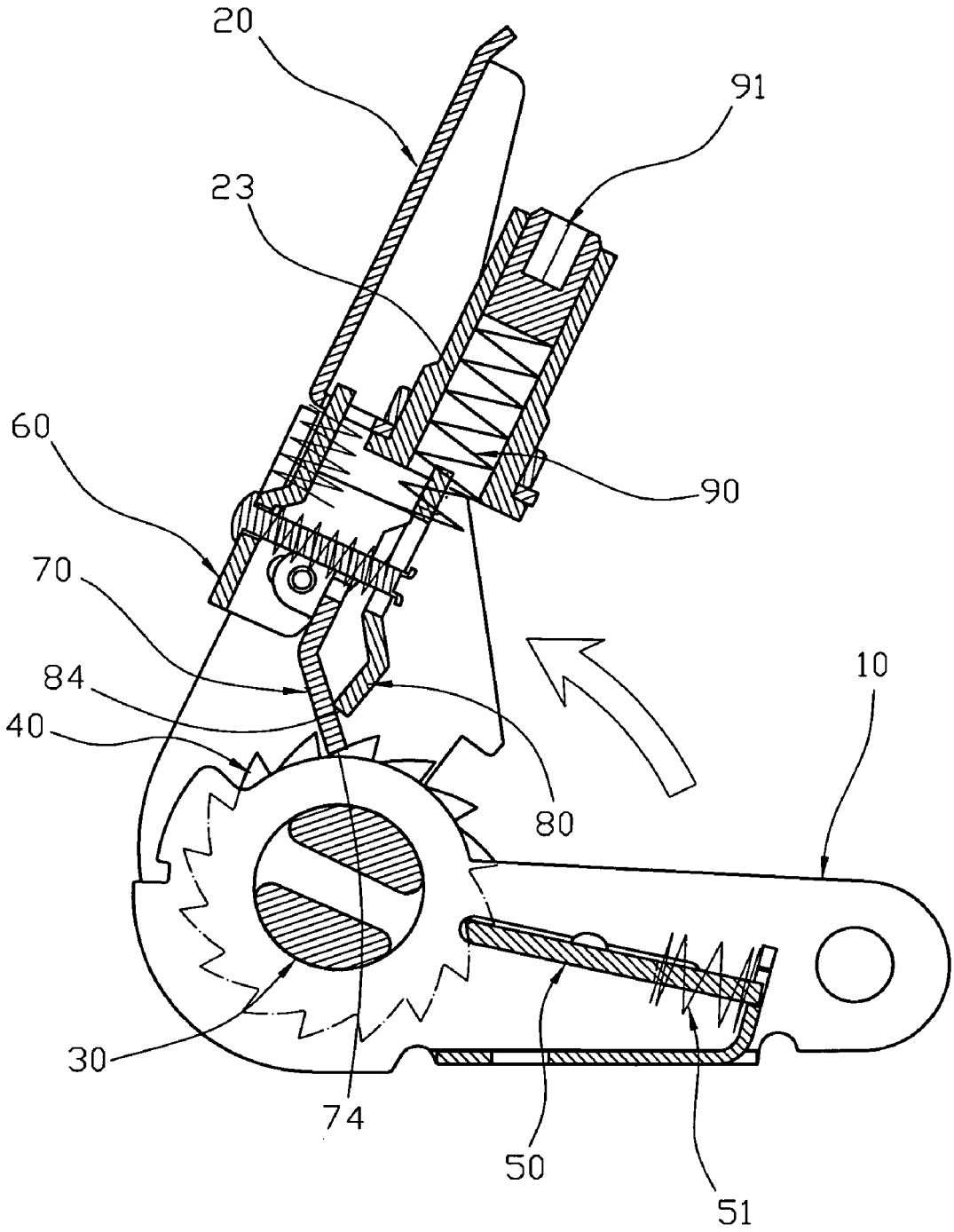
FIG. 5 is a schematic operational view of the cable tension device as shown in FIG. 4.

In operation, referring to FIGS. 1-5, when the movable seat 20 is rotatable relative to the fixing seat 10 forward (e.g., in the counterclockwise direction), the engaging board 70 is rotatable with the movable seat 20 to move from the position as shown in FIG. 4 to the position as shown in FIG. 5 to drive the ratchet unit 40 to rotate forward to rotate the rotation shaft 30 forward so as to wind the cable. At this time, the safety locking plate 50 is engaged with the ratchet unit 40 to prevent the ratchet unit 40 from being rotated backward (in the clockwise direction). On the contrary, when the movable seat 20 is rotatable relative to the fixing seat 10 backward (e.g., in the clockwise direction), the engaging board 70 is rotatable with the movable seat 20 to move from the position as shown in FIG. 5 to the position as shown in FIG. 4 to pass through the ratchet unit 40 without interfering with operation of the ratchet unit 40. Thus, the movable seat 20 is rotatable relative to the fixing seat 10 forward successively to rotate the rotation shaft 30 forward to wind and tighten the cable successively so as to bind a cargo.

Figure 6:
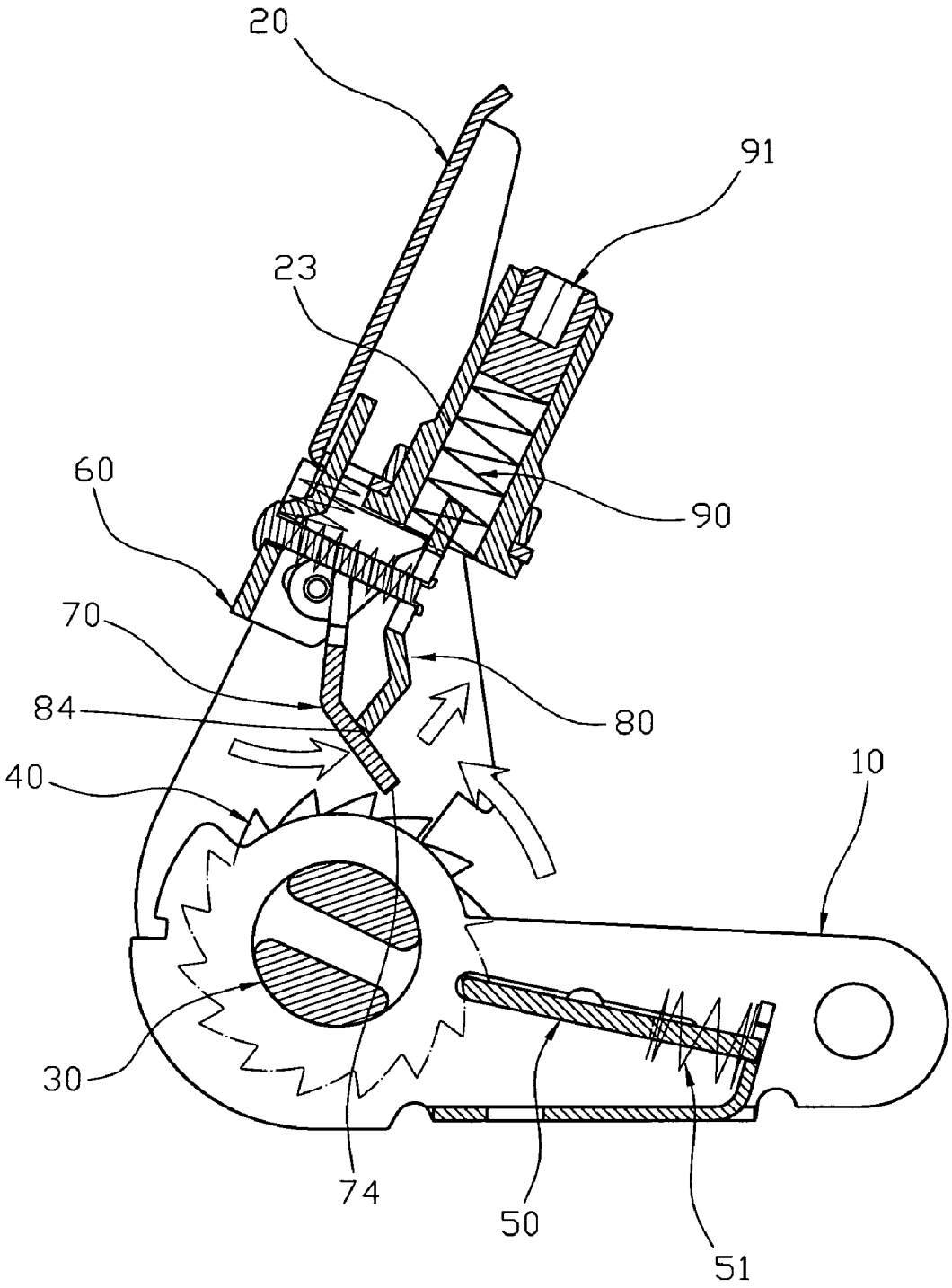
FIG. 6 is a schematic operational view of the cable tension device as shown in FIG. 5.

As shown in FIG. 6, when the cable is tightened to a determined extent by rotation of the movable seat 20, the force applied by the cable on the ratchet unit 40 is greater than that applied by the engaging board 70 and the push board 80 on the ratchet unit 40, so that the engaging board 70 is pushed and deflected by the ratchet unit 40 to pass by the ratchet unit 40, and the movable seat 20 performs an idle rotation, thereby preventing the cable from being tightened too excessively.

Figure 7:
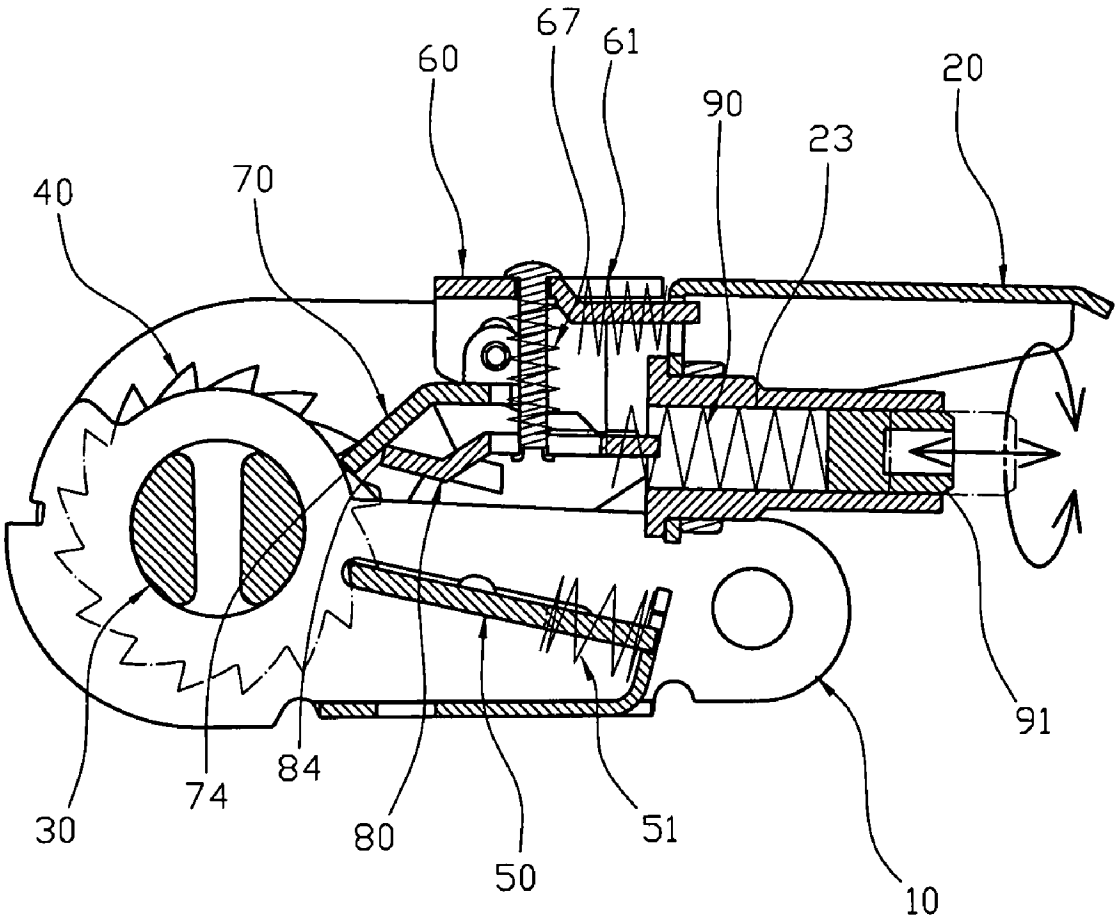
FIG. 7 is a schematic operational view of the cable tension device as shown in FIG. 4.

As shown in FIG. 7, the tension adjustment knob 91 is rotatable relative to the movable seat 20 to adjust the tension applied by the compression spring 90 on the push board 80 to adjust the force applied by the engaging board 70 and the push board 80 on the ratchet unit 40 so as to adjust the force for tightening the cable, thereby preventing the cargo from being broken by the cable due to an excessive force.

Figure 8:
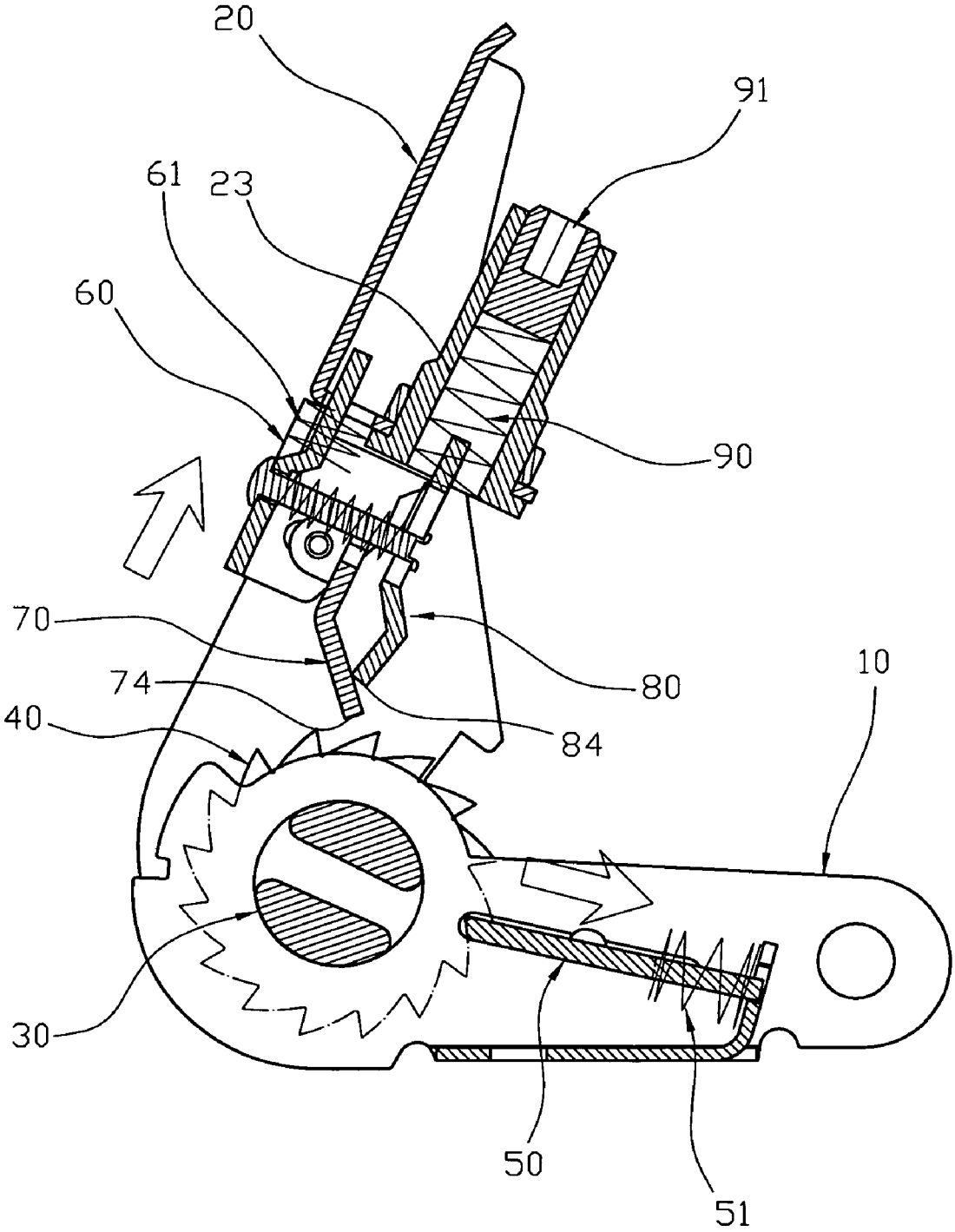
FIG. 8 is a schematic operational view of the cable tension device as shown in FIG. 4.

As shown in FIG. 8, when the control member 60 is movable outwardly relative to the ratchet unit 40, the engaging board 70 is movable with the control member 60 to disengage the ratchet unit 40, so that the movable seat 20 is rotatable freely relative to the fixing seat 10 to expose the safety locking plate 50. Thus, when the safety locking plate 50 is movable outwardly relative to the ratchet unit 40, the safety locking plate 50 is disengaged from the ratchet unit 40 to release the ratchet unit 40, so that the ratchet unit 40 is rotatable freely to unwind the cable.

Figure 9:
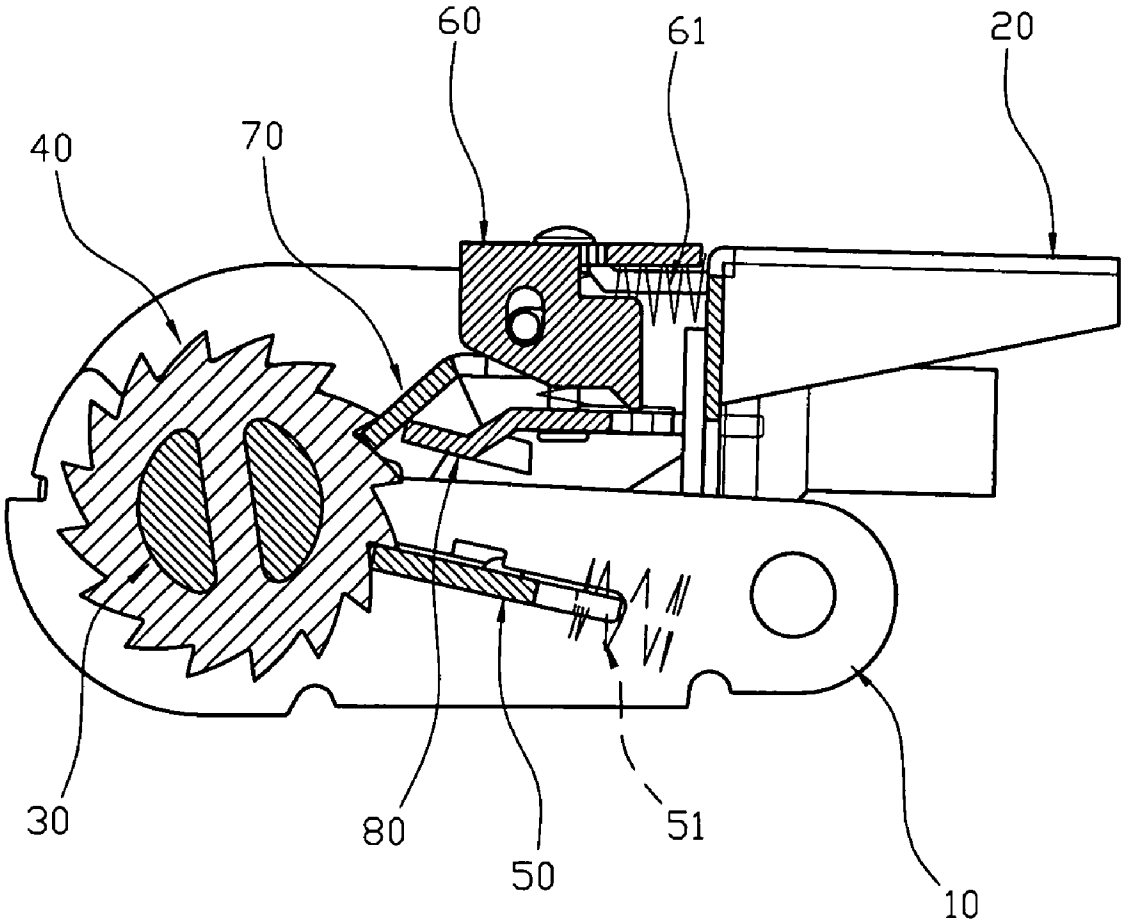
FIG. 9 is a plan cross-sectional view of the cable tension device as shown in FIG. 1.

As shown in FIG. 9, the control member 60 is not pressed downward.

Figure 10:
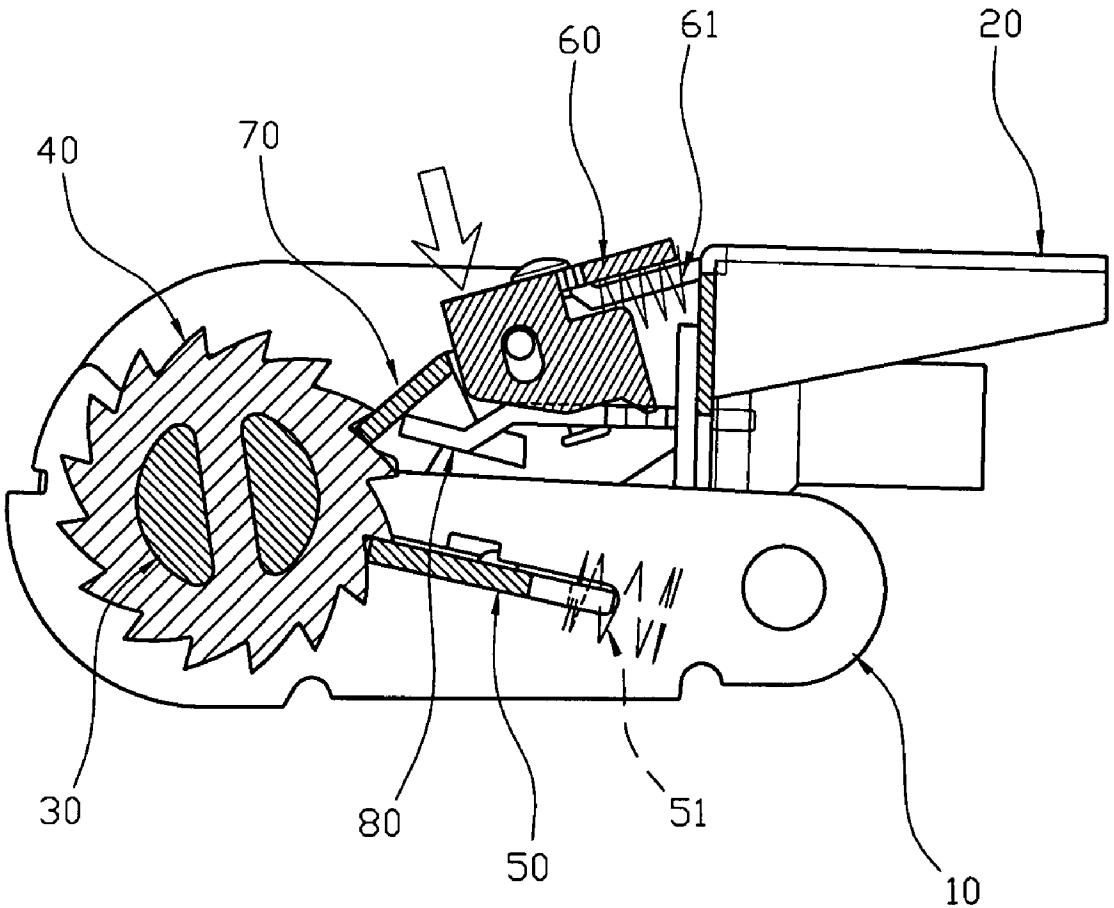
FIG. 10 is a schematic operational view of the cable tension device as shown in FIG. 9.

As shown in FIG. 10, the control member 60 is pressed downward to press the engaging board 70 so as to lock the engaging board 70 exactly and closely.

Accordingly, when the cable is tightened to a determined extent by rotation of the movable seat 20, the force applied by the cable on the ratchet unit 40 is greater than that applied by the engaging board 70 and the push board 80 on the ratchet unit 40, so that the engaging board 70 is pushed and deflected by the ratchet unit 40 to pass by the ratchet unit 40, and the movable seat 20 performs an idle rotation, thereby preventing the cable from being tightened too excessively. In addition, the tension adjustment knob 91 is rotatable relative to the movable seat 20 to adjust the tension applied by the compression spring 90 on the push board 80 to adjust the force applied by the engaging board 70 and the push board 80 on the ratchet unit 40 so as to adjust the force for tightening the cable, thereby preventing the cargo from being broken by the cable due to an excessive force.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A cable tension device, comprising:

a fixing seat;

a rotation shaft rotatably mounted on the fixing seat;

a ratchet unit secured on the rotation shaft to rotate the rotation shaft;

a movable seat rotatably mounted on the rotation shaft;

a safety locking plate movably mounted on the fixing seat and detachably engaged with the ratchet unit to allow the ratchet unit to rotate forward in one direction only;

a control member movably mounted on the movable seat;

an engaging board pivotally connected with the control member and detachably engaged with the ratchet unit to drive the ratchet unit to rotate forward in the one direction only;

a push board movably mounted on the movable seat and rested on the engaging board to push the engaging board to deflect forward in an inclined angle;

a compression spring biased between the movable seat and the push board to push the push board toward the engaging board;

a tension adjustment knob adjustably mounted on the movable seat and rested on the compression spring to adjust a tension applied by the compression spring on the push board.

2. The cable tension device in accordance with claim 1, wherein the movable seat has a first end rotatably mounted on the rotation shaft and a second end formed with a threaded adjusting hole, and the tension adjustment knob is a threaded rod screwed into the adjusting hole of the movable seat, so that the tension adjustment knob is rotatable relative to the movable seat to adjust the tension applied by the compression spring on the push board to adjust a force applied by the engaging board and the push board on the ratchet unit.

3. The cable tension device in accordance with claim 2, wherein the compression spring is mounted in the adjusting hole of the movable seat and biased between the tension adjustment knob and the push board.

4. The cable tension device in accordance with claim 1, further comprising an elastic member mounted on the control member and biased between the movable seat and the control member to push the control member toward the engaging board and to push the engaging board toward the ratchet unit.

5. The cable tension device in accordance with claim 1, wherein the movable seat has a mediate portion having two opposite sides each formed with a guide groove, and the engaging board has two opposite sides each formed with a protruding slide edge slidable in the respective guide groove of the movable seat.

6. The cable tension device in accordance with claim 1, wherein the engaging board has a first end formed with an engaging end detachably engaged with the ratchet unit and a second end formed with two upward extending pivot ears pivotally mounted in the control member.

7. The cable tension device in accordance with claim 6, wherein the movable seat has a mediate portion having two opposite sides each formed with a guide slot, the control member has two downward extending slides each movably mounted in the movable seat and each formed with an oblong guide hole, and the cable tension device further comprises a pivot pin extended through the guide slots of the movable seat, the guide holes of the control member and the pivot ears of the engaging board.

8. The cable tension device in accordance with claim 7, wherein the control member is movable forward and backward on the movable seat by guidance of the guide slots of the movable seat and is movable upward and downward on the movable seat by guidance of the guide holes of the control member.

9. The cable tension device in accordance with claim 7, wherein the engaging board is movable with the control member and is pivotable relative to the control member by pivot of the pivot pin.

10. The cable tension device in accordance with claim 1, wherein the movable seat has a mediate portion having two opposite sides each formed with two guide channels, and the push board has two opposite sides each formed with two protruding slide portions each slidable in the respective guide channel of the movable seat.

11. The cable tension device in accordance with claim 1, wherein the control member has a face formed with a through hole, the push board has a first end formed with a push end rested on the first end of the engaging board and a second end formed with an elongated limit slot, and the cable tension device further comprises a limit pin extended through the through hole of the control member and the limit slot of the push board, and a restoring spring mounted on the limit pin and biased between the control member and the push board to push the control member upward and downward.

12. The cable tension device in accordance with claim 11, wherein the push board is movable forward and backward relative to the control member by guidance of the limit pin.

13. The cable tension device in accordance with claim 11, wherein the engaging board is formed with an arcuate recess to receive the limit pin.

14. The cable tension device in accordance with claim 1, wherein the fixing seat has a mediate portion formed with an elongated slideway in which the safety locking plate movable.

15. The cable tension device in accordance with claim 1, wherein the rotation shaft is rotatably mounted on a first end of the fixing seat, and the cable tension device further comprises a push spring biased between a second end of the fixing seat and the safety locking plate to push the safety locking plate toward the ratchet unit.

16. The cable tension device in accordance with claim 1, wherein the control member has a substantially inverted U-shaped cross-sectional profile.

17. The cable tension device in accordance with claim 1, wherein the ratchet unit is located on two ends of the rotation shaft.

18. The cable tension device in accordance with claim 1, wherein when a force applied by the cable on the ratchet unit is greater than that applied by the engaging board and the push board on the ratchet unit, the engaging board is pushed and deflected by the ratchet unit to pass by the ratchet unit, and the movable seat performs an idle rotation.

19. The cable tension device in accordance with claim 1, wherein the elastic member pushes the control member toward the engaging board and pushes the engaging board toward the ratchet unit, so that the engaging board is engaged with the ratchet unit at a normal state, while the compression spring pushes the push board toward the engaging board to push the engaging board to deflect forward in an inclined angle, so that the engaging board is engaged with the ratchet unit at the normal state.

20. The cable tension device in accordance with claim 1, wherein when the control member is movable outwardly relative to the ratchet unit, the engaging board is movable with the control member to disengage the ratchet unit, so that the movable seat is rotatable freely relative to the fixing seat to expose the safety locking plate.

* * * * *